United States Patent [19]

Burton

[11] Patent Number: 4,982,877

[45] Date of Patent: Jan. 8, 1991

[54] REPLACEABLE CONTAINER FOR FLUID DISPENSER

[76] Inventor: John W. Burton, 4 Woodland Dr., Pittsburgh, Pa. 15228

[21] Appl. No.: 287,723

[22] Filed: Dec. 21, 1988

Related U.S. Application Data

[63] Continuation-in-part of Ser. No. 41,214, Apr. 22, 1987, Pat. No. 4,793,518.

[51] Int. Cl.[5] ..... B67D 5/56

[52] U.S. Cl. ..... 222/321; 222/135; 222/255; 222/325

[58] Field of Search ..... 222/180, 143, 540, 132, 222/135, 144.5, 124.1–129.4, 255, 321, 325, 383, 385; 215/1 C; 220/69

[56] References Cited

U.S. PATENT DOCUMENTS

| | | | |
|---|---|---|---|
| 1,202,192 | 10/1916 | Knight | 222/129.3 |
| 1,907,301 | 5/1933 | Martin | 222/540 X |
| 1,944,809 | 1/1934 | Rogers | 222/129.3 |
| 2,160,983 | 1/1939 | Painter | 222/135 |
| 2,515,570 | 7/1950 | Rubinfield | 222/135 |
| 2,883,043 | 5/1975 | Lane | 222/82 |
| 3,141,573 | 7/1964 | Patch et al. | 222/129.1 |
| 3,206,069 | 9/1965 | Jacobs et al. | 222/1 |
| 3,225,965 | 12/1965 | Jacobs et al. | 222/129.1 |
| 3,250,434 | 5/1966 | Howlett | 222/143 |
| 3,302,831 | 2/1967 | Matheney | 222/108 |
| 3,349,967 | 10/1967 | Schneller | 222/130 |
| 3,664,550 | 5/1972 | Carothers et al. | 222/129.2 |
| 3,765,574 | 10/1973 | Urguiza | 222/183 |
| 4,162,029 | 7/1979 | Gottsegen et al. | 222/131 |
| 4,173,296 | 11/1979 | Marshall | 222/129.1 |
| 4,319,698 | 3/1982 | Tomiyama et al. | 222/129.1 |
| 4,351,454 | 9/1982 | Maynard | 222/143 |
| 4,440,318 | 4/1984 | Berger | 222/129.1 |
| 4,493,441 | 1/1985 | Sedam et al. | 222/129.1 |
| 4,541,529 | 9/1985 | Hestehave et al. | 206/510 |
| 4,632,268 | 12/1986 | Melzi et al. | 220/1 C |
| 4,757,920 | 7/1988 | Harootian, Jr. et al. | 222/146.6 |

FOREIGN PATENT DOCUMENTS

| | | | |
|---|---|---|---|
| 300819 | 1/1989 | European Pat. Off. | 222/190 |
| 1565679 | 5/1969 | France | 222/466 |
| 2000485 | 1/1979 | United Kingdom . | |

*Primary Examiner*—Michael S. Huppert

*Attorney, Agent, or Firm*—Buchanan Ingersoll; Lynn J. Alstadt

[57] ABSTRACT

A replaceable fluid container is described for use in a plunger-type fluid dispenser of the type disclosed in U.S. Pat. No. 4,793,518. The fluid container is generally rectangular in shape and has a recess in the top surface from which a neck extends. The neck and an associated closure are sized to terminate flush with a plane containing the top surface of the container and is positioned for alignment with specific elements of the dispenser. The container, either alone or in conjunction with a spacer, preferably has a width of a intergral multiple of about 2⅛ inches, a height of about 9¼ inches, and a depth of about 5 to about 6½ inches.

7 Claims, 4 Drawing Sheets

REPLACEABLE CONTAINER FOR FLUID DISPENSER

CROSS REFERENCE TO RELATED APPLICATION

This application is a continuation, in part, of U.S. Ser. No. 041,214, filed Apr. 22, 1987, which matured into U.S. Pat. No. 4,793,518, issued Dec. 27, 1988.

FIELD OF INVENTION

The present invention relates to a container for a fluid dispenser. More specifically, it relates to a replaceable container for use with the dispenser described in U.S. Pat. No. 4,793,518, issued Dec. 27, 1988.

DESCRIPTION OF THE PRIOR ART

Containers and other receptacles for holding and transporting fluids are well known. Specifically, containers for use with plunger-type pumps are utilized for soft soap and detergents, among other liquids. These containers have been made in a variety of sizes and are either cylindrical or rectangular. Whatever the shape, the plunger type pump has generally been centered on the bottle. The position provides greatest stability to the bottle, particularly when pressure is applied against the plunger type pump.

I have found that the common containers having plunger type pumps will work in my dispenser disclosed in my U.S. Pat. No. 4,793,518. However, use of such containers creates much empty, wasted space within my dispenser. Consequently, I have designed a bottle particularly useful for my dispenser. This bottle maximizes space utilization in my dispenser and is easy to remove from and insert into the dispenser. Although my bottle will tip easily when used outside my dispenser, it is stable within the dispenser. Moreover, a pump type valve on my container will be in perfect alignment with the activator rod wherever the container is placed among the several containers in the dispenser.

SUMMARY OF THE INVENTION

I provide a container having a top with a flat surface which has a recessed portion at one end. A neck extends outwardly from the recessed portion and rises perpendicular to the top. A closure is attached to the neck with the closure and neck sized so that the closure terminates at a plane which is flush with the top surface. The neck is sized to receive the plunger- type pump, and may be threaded to receive a cap. Alternately, the neck may be sealed with a sealing material that may be broken before insertion of the pump. The dimensions of the container are fairly specific, because of spacing constraints. The fluid container has a width of a integral multiple of about 2⅛ inches, a height of about 9¼ inches, and a depth of about 5 to about 6½ inches. This allows for one, two, three or four bottles to be inserted into the housing. A larger bottle, therefore, could have one flavor and take the space of two or more smaller bottles, provided that it was the right size and had a correctly positioned neck.

The container may also be used in conjunction with a spacer mounted adjacent to the bottom of the container to allow a container which is smaller than the preferred dimensions to be utilized in the dispenser. The size requirement is thus fulfilled by a fluid container with a width of about 2⅛ inches or multiples thereof, the spacer and bottle having a combined height of about 9¼ inches, and a depth of about 5 to about 6½ inches.

In my dispenser there is a lever within the housing which is pivotable in both the vertical and horizontal directions. I provide a horizontal bar which is positioned to extend in front of the plunger-type pumps. This horizontal bar is connected to a push-type valve which dispenses the liquid base material, preferably from a pressurized container. I prefer to provide a front plate on the housing which has a horizontal slot from which a series of vertical slots are extended. The lever extends through the horizontal slot and can be positioned over any vertical slot. Each slot corresponds to a flavor and one liquid only selection. Thus, when the lever is pushed through a vertical slot, it will now be over a flavor pump and the selected flavor syrup will be dispensed. The neck of each container is positioned in alignment with a slot of the dispenser when the container is inserted therein, such that the pump is depressed when the lever is moved downwardly within the associated slot.

Flavor syrup is dispensed from my container by positioning the moveable lever over the pump of a flavor dispenser and pressing down. This causes the plunger of the pump to also move downward and release flavor syrup. If one continues to press the lever down it will strike the bar which controls the delivery of liquid. Continued downward pressure on the lever will push the bar down which opens the valve and dispenses the base liquid. The neck is preferably sized and mounted at such a height so that when the container is in the dispenser, and the lever is engaged to activate the pump, the bar will move the valve stem to open the valve when the lever has traveled 95% of its total stroke.

The container may additionally be provided with a series of indentations or protrusions in the side walls to increase the strength of the container and to keep bulging to a minimum.

BRIEF DESCRIPTION OF THE PREFERRED EMBODIMENTS

Figure 1:
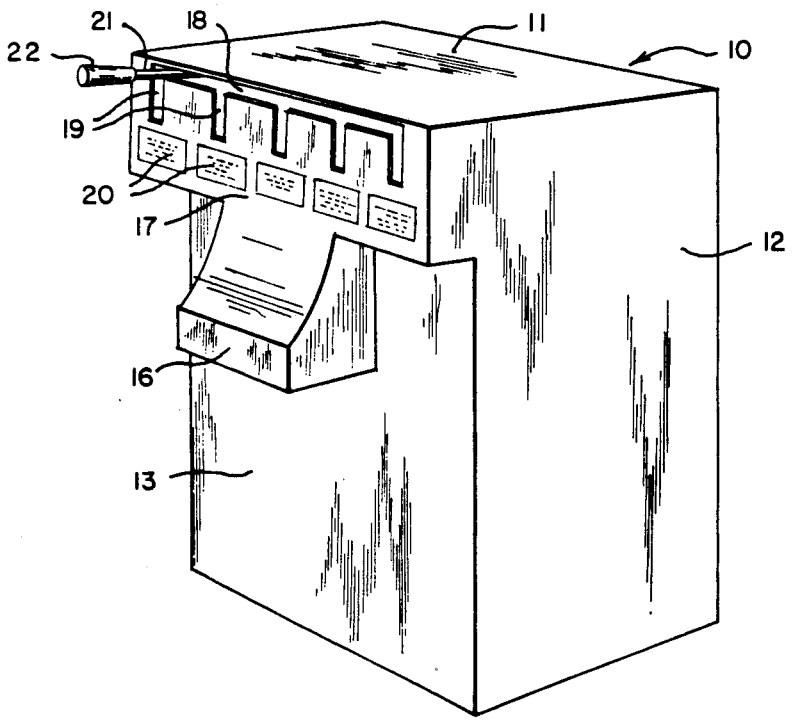
FIG. 1 is a perspective view of the dispenser.
Figure 2:
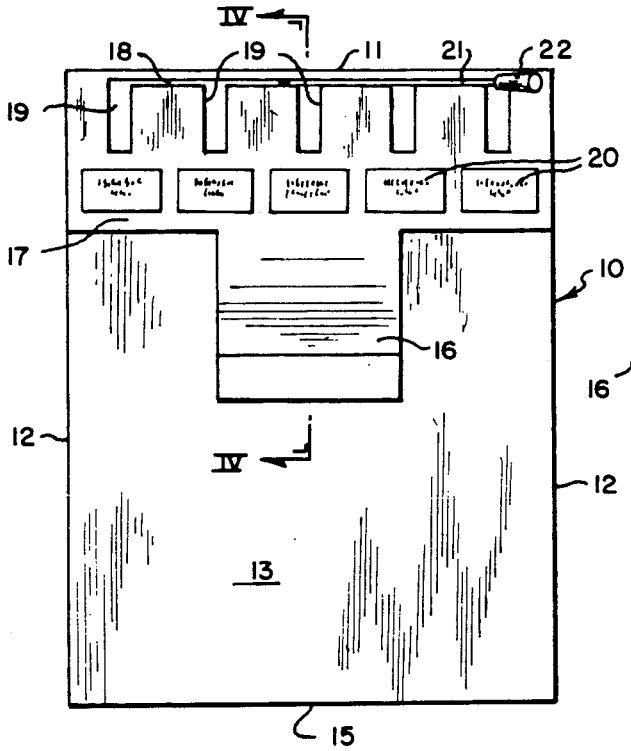
FIG. 2 is a front view of the embodiment of FIG. 1.
Figure 3:
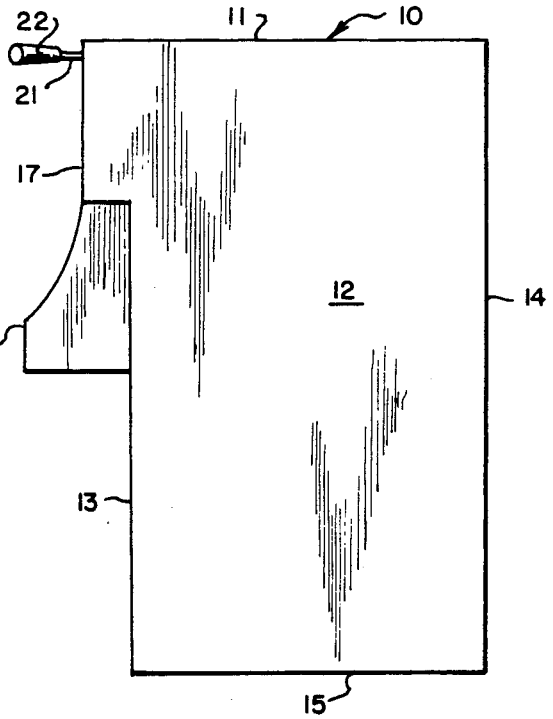
FIG. 3 is a side elevation view of the dispenser as viewed from the right side of FIG. 2.

As shown in FIGS. 1, 2 and 3, my dispenser has a housing 10 in which there are contained a plurality of flavor or pigment containers. Housing 10 is generally rectangular having a flat top 11, opposite sides 12, front 13, optional back 14 and bottom 15. A nozzle hood 16 and front plate 17 are attached to the front. A horizontal slot 18 and a plurality of vertical slots 19 are provided in the front plate 17. I prefer to provide labels 20 on the front plate 17 to identify each vertical slot 19. A lever 21 with a handle 22 extends through slot 18. This lever 21 is attached to the housing 10 by a universal joint 23 (see FIG. 4). This permits the lever to be moved horizontally through slot 18 and vertically through any slot 19.

Figure 4:
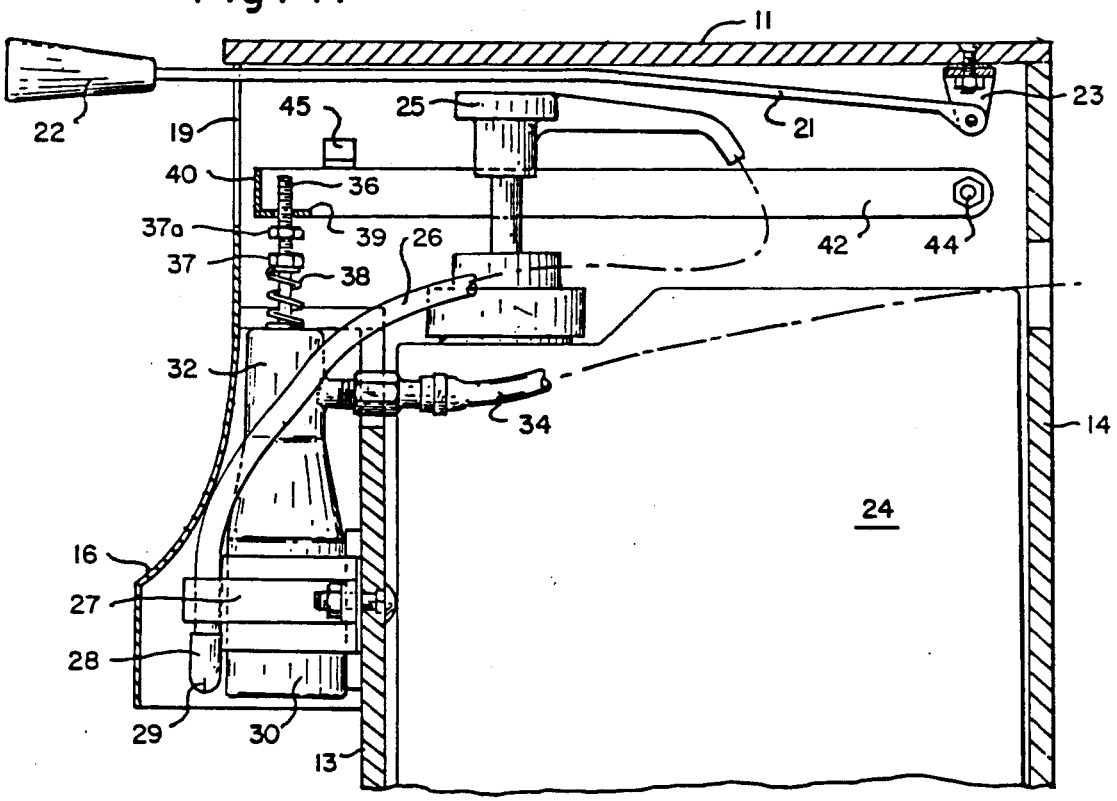
FIG. 4 is a sectional view of the top half of the dispenser taken along the line IV—IV of FIG. 2.
Figure 5:
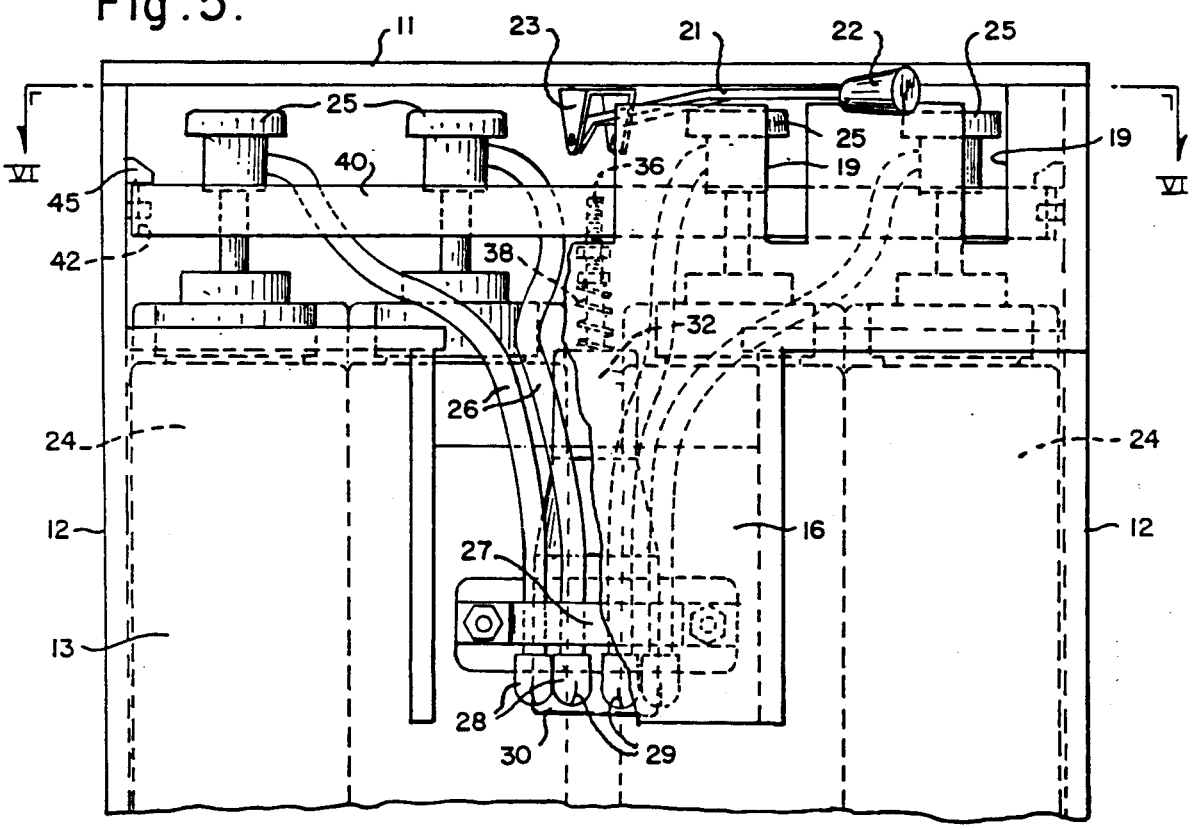
FIG. 5 is a front view of the top half of the dispenser with the nozzle hood and a portion of the front plate removed.
Figure 6:
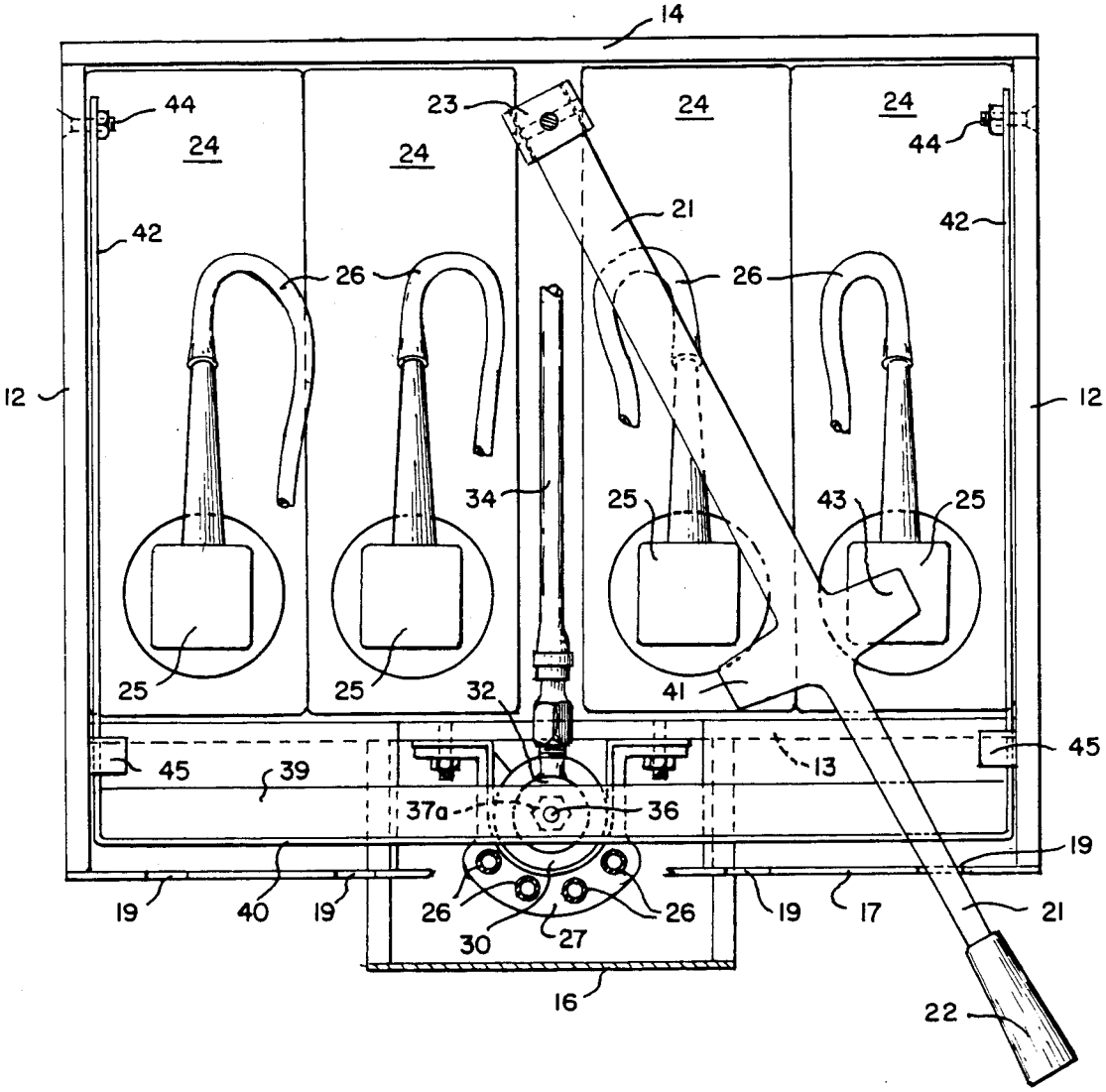
FIG. 6 is a cross-sectional view taken along line VI—VI of FIG. 5.

As shown in FIGS. 4 thru 6, I provide a plurality of flavor containers 24 which are placed in the housing on bottom 15. Preferably, the containers are relatively narrow to allow several containers to fit within the housing 10. These containers 24 can be replaced simply by removing the back 14 of the housing 10 and sliding the container out. On each container there is a plunger-type pump 25. By pushing the plunger 25 down one pumps pigment or flavor from container 24. As shown in FIG. 5, I prefer to use the same plunger-type pump 25 for all containers 24. I also prefer to make containers 24 with standard height and depth, and one of four standard widths. Should the internal width of the dispenser be wider than the combined width of the containers 24, a spacer (not shown) may be inserted in the space between the bottles. Such a space is shown in FIG. 5. The containers 24 are interchangeable and every plunger 25 will fit every container 24. I further prefer to make both the containers 24 and plungers 25 of plastic.

A tube 26 extends from each plunger-type pump 25 to a remote position beneath which one may place a cup or other container. At the distal end of tube 26 there is an eye dropper type valve 28 with a slit 29. Tubes 26 are arranged in a spacer 27 about a diffuser or other nozzle 30 which is connected to a plug valve 32 that in turn is connected to supply tube 34. Tube 34 leads to a remote source of preferably pressurized liquid such as club soda. The liquid source may also be positioned to allow gravity feed of liquid. Plug valve 32 has a stem 36 which extends upwardly through bar 40. A spring 38 is provided on the stem to keep plug valve 32 closed while under pressure from liquid in supply tube 34 and to maintain bar 40 in a predetermined rest position. In this rest position valve 32 is closed. Stem 36 is threaded at its upper end and extends through a hole in tab 39 on bar 40. Nut 37 is provided on stem 36 to adjust the tension on spring 38 and plug valve 32. A second nut 37*a* determines the point where bar 40 engages valve stem 36. Control bar 40 has arms 42 which extend from either end and are pivotally attached to sides 12 by connectors 44. Because it is pivotably attached through arms 42, bar 40 can move up and down. Normally spring 38 will keep bar 40 in its uppermost position as shown in the drawings. Screws or bosses 45 may be provided in both sides 12 of the housing 10 to block upward movement of bar 40 above a predetermined position. In this position plug valve 32 is closed and no liquid flows through nozzle 30. When lever 21 is moved through a vertical slot 19 it will engage bar 40 and press it down. Downward movement of bar 40 opens valve 32 and allows liquid to flow through nozzle 30. When lever 21 is at its lowermost position in slot 19, valve 32 will be fully open. As can be seen in FIG. 5 I prefer to allow lever 21 to travel about 85% through slot 19 before it engages bar 40. As will be seen, this allows me to pump flavors from a container 24 without dispensing liquid through nozzle 30. Further downward movement of lever 21 releases and mixes both flavor syrup and liquid soda water.

As can be clearly seen in FIG. 6, lever 21 is pivotally attached by joint 23 to housing 10 which allows it to be positioned over any of the flavor pumps 25 or in a neutral position immediately above valve 32. I have found it desirable to provide wings 41 and 43 on the leVer for easy engagement of the tops of the flavor pumps 25. As can be seen from FIG. 6, when the lever 21 is in a far right position, wing 43 will be over the far right flavor pump. Conversely, wing 41 will be over the far left flavor pump when lever 21 is in the far left slot. The centerline of lever 21 will be over a flavor pump when it is in the left center slot or the right center slot. Only liquid, such as club soda, can be released when lever 21 moves downward and depresses bar 40. When lever 21 is in the center slot no flavor pump can be activated. When lever 21 or its wings 41 and 43 is over flavor pump 25 one can dispense flavor by pressing the lever down until it reaches bar 40. If one continues to press lever 21 downwardly it will engage bar 40. As bar 40 moves downward it moves valve stem 36 which opens plug valve 32 allowing liquid to be dispensed through the diffuser 30. If one stops the downward motion of lever 21 when it reaches bar 40 and returns lever 21 to its original, uppermost position one can dispense more flavor without any liquid having been dispensed. When lever 21 is in the center slot only liquid can be dispensed. Thus, the user can determine both the variety and amount of flavor dispensed. My dispenser also enables the user to select only flavor syrup or only liquid such as club soda.

Figure 7:
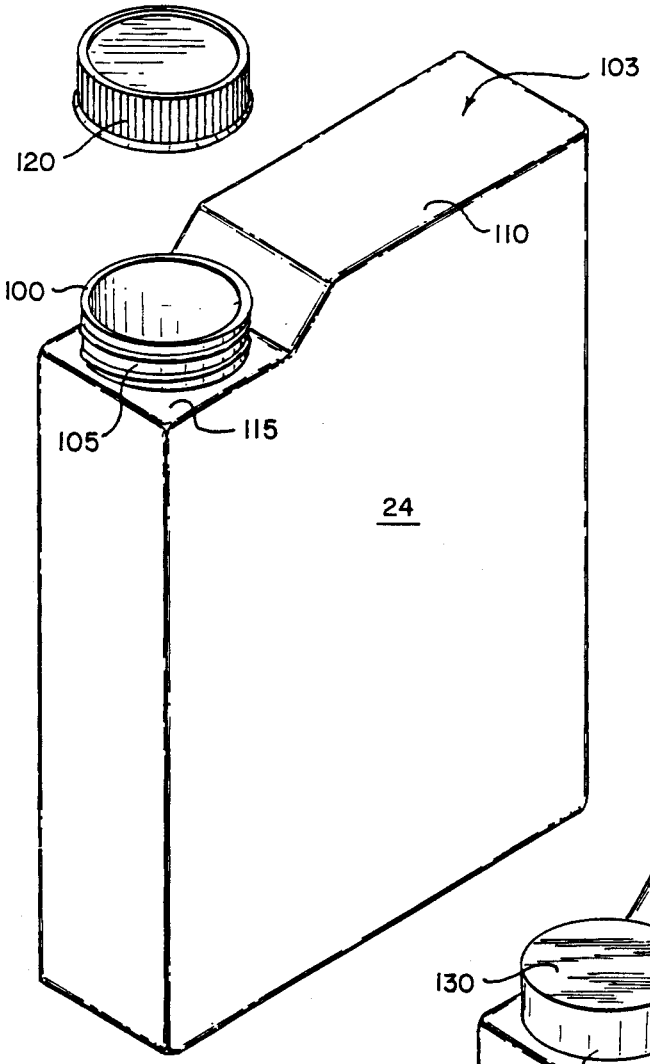
FIG. 7 is a perspective view of a present preferred embodiment of my container.
Figure 8:
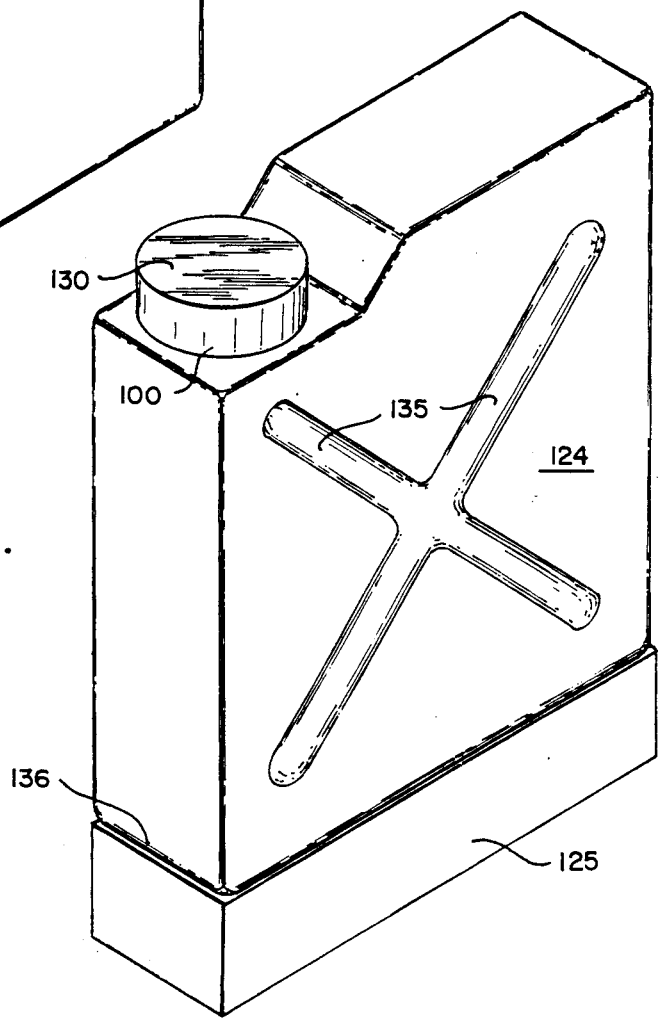
FIG. 8 is a perspective view of a second preferred embodiment of my container.

Referring to FIG. 7, the fluid container has a top 103 having a recessed portion 115 at one end and a top surface 110 at an opposite end. A neck 100 extends outwardly from the recessed portion 115 and perpendicular to the top surface 110. A neck closure, which may be a threaded cap 120, as shown in FIG. 7 or a seal, as shown in FIG. 8 is provided such that the neck 105 and threaded cap 120 or seal 130 terminates at a plane which contains the top surface 110. The fluid container has a width of a integral multiple of about 2⅛ inches, a height of about 9¼ inches, and a depth of about 5 to about 6½ inches. This requires that a container be either 2⅛, 4¼, 6⅜ or 8½ inches in width. A plurality of threads 105 may be provided on the neck to allow closure by threaded cap 120.

Referring to FIG. 8, a second embodiment of the container 124 is shown. The container 124 is characterized by its smaller size than container 24. To compensate for the smaller sized container, a spacer 125 is utilized, mounted adjacent to the bottom 136 of container 124. This allows the smaller container 124 to be utilized and still comply with the somewhat rigid spatial restraints of the dispenser. Seal 130 may be provided across neck 100 in place of the threaded cap shown in FIG. 7. Additionally, the external surface of the container may be deformed by indentations 135 or other deformations in the top, bottom or sidewalls (not shown) to add strength and prevent bulging of the container when full.

In the drawings I have shown four flavor containers 24 and one neutral position. It should be readily apparent to those skilled in the art that a greater or lesser number of containers may be used. However, I have found that four containers each having a capacity of approximately 32 or 64 ounces provides an adequate selection for most people. Since the containers are easily removable one may keep additional flavor containers on hand and interchange them as desired.

I prefer to make nearly all of the components of my dispenser from plastic. Then my dispenser is inexpensive, lightweight and easily placed on a counter or bar.

I have described and illustrated activation of the pumps and horizontal bar by movement of the lever toward the base of the container which I call downward movement. It should be apparent to those skilled in the art that pumps 25, bar 40 and lever 21 could be sized and positioned so that movement of the lever upward toward the top of the container activates the pumps and liquid dispenser valve. Also one could easily rotate my dispenser ninety degrees without departing from my invention even though the horizontal slot is now vertical and the vertical slots are horizontal.

Even though I have described this dispenser in the context of carbonated beverages, it should be readily apparent that one could use a variety of materials with this dispenser. For example, one might choose to fill containers 12 with various types of liquors and dispense club soda. One might also choose to fill containers 24 with pigments and dispense white paint. I have shown a diffuser valve in this dispenser, but it should be readily apparent that the diffuser is not necessary particularly where non- carbonated liquids are being dispensed.

Although I have shown and described various embodiments of the present invention, it should be distinctly understood that the invention is not limited thereto, but may be variously embodied within the scope of the following claims.

I claim:

1. A removable fluid container for use in a dispenser of the type comprising a housing having a base and a front, wherein an opening is provided in the front through which liquids can be dispensed, a first slot and at least one second slot extending at an angle from the first slot provided in the front, the housing being sized to hold at least one container having a plunger type pump attached to the container and a tube extending from the pump to the opening at the front plate, a nozzle attached to the housing in a manner to allow liquid to flow through the nozzle and out of the opening in the front plate, a valve attached to the nozzle having an outwardly extending stem movement of which opens and closes the valve and having an inlet which may be connected to a liquid supply, a bar pivotally attached to the housing, said bar extending substantially parallel to the first slot and attached to the valve stem so that movement of the bar will move the valve stem to open the valve, and a lever attached to the housing in a manner so that it may extend and move through the first and second slots and sied and positioned so that it will engage and activate a plunger type pump and the bar when moved downwardly through a second slot, the fluid container being generally rectangular in shape, comprising:

a top, a bottom and four sidewalls extending between the top and bottom, the top having a recessed portion extending across one end and touching three of the sidewalls and having a top surface at an opposite end;

a neck centered on and extending outwardly from the recessed portion and perpendicular to the top surface, the neck adapted to receive a plunger type pump whereby the pump will be positioned in alignment with the lever when the container is inserted within the dispenser and the lever is positioned within an associated slot of the dispenser;

a closure attached to the neck to seal the container, the neck and closure being sized to terminate in a plane which extends through the top surface; and a plunger type pump attached to the neck, the neck and pump sized and mounted at such a height so that when the container is in the dispenser, and the lever is engaged to activate the pump, the bar will move the valve stem to open the valve when the lever has traveled 85% of its total stroke.

2. A removable fluid container as described in claim 1, having at least one indentation in at least one of the top, the bottom and the sidewalls of the container.

3. A removable fluid container as described and claimed in claim 1, wherein the fluid container has a width of an integral multiple of about 2⅛ inches, a height of about 9¼ inches, and a depth of about 5 to about 6½ inches.

4. A removable fluid container as described in claim 1, wherein the container is constructed of plastic.

5. A removable fluid container as described in claim 1 having at least one indentation in at least one of the top, the bottom and the sidewalls of the container.

6. A removable fluid container as described in claim 1 also comprising spacing means adjacent to the bottom of the container.

7. A removable fluid container as described in claim 6, wherein the fluid container including the spacing means has a width of an integral multiple of about 2⅛ inches, a height of about 9¼ inches, and a depth of about 5 to about 6½ inches.

* * * * *

UNITED STATES PATENT AND TRADEMARK OFFICE

CERTIFICATE OF CORRECTION

PATENT NO. : 4,982,877

DATED : January 8, 1991

INVENTOR(S) : JOHN W. BURTON

It is certified that error appears in the above-identified patent and that said Letters Patent is hereby corrected as shown below:

ON TITLE PAGE:

At 56, References Cited, change "2,883,043" to --3,883,043--.

Column 3, line 68, change "leVer" to --lever--.

Signed and Sealed this

Twelfth Day of May, 1992

*Attest:*

DOUGLAS B. COMER

*Attesting Officer*

*Acting Commissioner of Patents and Trademarks*